US009928774B2

(12) United States Patent
Ma

(10) Patent No.: US 9,928,774 B2
(45) Date of Patent: Mar. 27, 2018

(54) PIXEL DRIVING UNIT AND DRIVING METHOD THEREOF, AND PIXEL CIRCUIT

(71) Applicant: BOE TECHNOLOGY GROUP CO., LTD., Beijing (CN)

(72) Inventor: Zhanjie Ma, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/366,115

(22) PCT Filed: Nov. 28, 2013

(86) PCT No.: PCT/CN2013/088010
§ 371 (c)(1),
(2) Date: Jun. 17, 2014

(87) PCT Pub. No.: WO2015/027589
PCT Pub. Date: Mar. 5, 2015

(65) Prior Publication Data

US 2015/0194092 A1 Jul. 9, 2015

(30) Foreign Application Priority Data

Aug. 29, 2013 (CN) ..... 2013 1 0385314

(51) Int. Cl.
*G09G 3/3233* (2016.01)

(52) U.S. Cl.
CPC ... *G09G 3/3233* (2013.01); *G09G 2300/0842* (2013.01); *G09G 2320/0233* (2013.01); *G09G 2320/045* (2013.01)

(58) Field of Classification Search
CPC ..... G09G 3/3241
See application file for complete search history.

(56) References Cited

U.S. PATENT DOCUMENTS

2002/0196208 A1* 12/2002 Nanno ..... G09G 3/3655 345/55
2003/0062844 A1 4/2003 Miyazawa
(Continued)

FOREIGN PATENT DOCUMENTS

CN 1361510 A 7/2002
CN 101261810 A 9/2008
(Continued)

OTHER PUBLICATIONS

Chinese Office Action of Chinese Application No. 201310385314.3, dated Jan. 6, 2015 with English translation.
(Continued)

*Primary Examiner* — Patrick Edouard
*Assistant Examiner* — Matthew Yeung
(74) *Attorney, Agent, or Firm* — Collard & Roe, P.C.

(57) ABSTRACT

The present disclosure relates to a technical field of display, and more particularly, to a pixel driving unit and a driving method thereof, as well as a pixel circuit comprising the pixel driving unit; the pixel driving unit comprises a driving sub-circuits and a control sub-circuit, wherein the control sub-circuit is connected to a data line, and the driving sub-circuits are connected to the control sub-circuit. In the process of driving the light emitting device, the pixel driving unit can effectively eliminate the nonuniformity due to the threshold voltage of the driving transistor and a phenomenon of image sticking due to the threshold voltage drift, avoid a problem of nonuniform brightness of the active matrix OLED due to the difference of the threshold voltages of the driving transistors thereof between the light emitting devices of different pixel driving units of the active matrix OLED, and improve the driving effect of the pixel driving unit with respect to the light emitting device, and further improve the quality of the active matrix OLED.

10 Claims, 3 Drawing Sheets

(56) References Cited

U.S. PATENT DOCUMENTS

| | | | | |
|---|---|---|---|---|
| 2003/0067455 | A1* | 4/2003 | Kasai | G09G 3/3233 345/204 |
| 2005/0093791 | A1* | 5/2005 | Lo | 345/82 |
| 2006/0082524 | A1 | 4/2006 | Kwon | |
| 2007/0013613 | A1* | 1/2007 | Umezaki | G09G 3/20 345/55 |
| 2008/0224960 | A1 | 9/2008 | Le Roy et al. | |
| 2008/0231562 | A1* | 9/2008 | Kwon | G09G 3/3233 345/77 |
| 2009/0167648 | A1* | 7/2009 | Jeon et al. | 345/76 |
| 2012/0162177 | A1* | 6/2012 | Lee | 345/211 |
| 2013/0069852 | A1 | 3/2013 | Liao et al. | |

FOREIGN PATENT DOCUMENTS

| | | | |
|---|---|---|---|
| CN | 101373577 | A | 2/2009 |
| CN | 100472812 | C | 3/2009 |
| CN | 101976545 | A | 2/2011 |
| CN | 102629447 | A | 8/2012 |
| CN | 103117040 | A | 5/2013 |
| CN | 103208255 | A | 7/2013 |
| JP | 2004062199 | A | 2/2004 |

OTHER PUBLICATIONS

English Translation of the International Search Report of PCT/CN2013/088010, dated Jun. 10, 2014.

International Search Report, International Preliminary Report on Patentability and Written Opinion of the International Searching Authority of PCT/CN2013/088010 in Chinese, dated Jun. 10, 2014.

Second Chinese Office Action of Chinese Application No. 201310385314.3, dated Jun. 19, 2015 with English translation.

English translation of the International Preliminary Report on Patentability and Written Opinion of the International Searching Authority of PCT/CN2013/088010, dated Mar. 1, 2016.

* cited by examiner

PIXEL DRIVING UNIT AND DRIVING METHOD THEREOF, AND PIXEL CIRCUIT

CROSS REFERENCE TO RELATED APPLICATIONS

This application is the National Stage of PCT/CN2013/088010 filed on Nov. 28, 2013, which claims priority under 35 U.S.C. § 119 of Chinese Application No. 201310385314.3 filed on Aug. 29, 2013, the disclosure of which is incorporated by reference.

TECHNICAL FIELD

The present disclosure relates to a technical field of display, and particularly, to a pixel driving unit and a driving method thereof, as well as a pixel circuit comprising the pixel driving unit.

BACKGROUND

As a light emitting device of current type, organic light-emitting diodes (OLEDs) have been increasingly applied to active matrix OLED of high performance. Conventional passive matrix OLED requires a shorter driving time for a single pixel with increase of display size, and thus needs to increase transient current and increase power consumption. In the meanwhile, application of large current may cause a voltage drop on lines of nanometer ITOs (Indium Tin Oxides) to be excessively large and cause the operational voltage of the OLED to be excessively high, and hence the efficiency thereof is decreased. However, active matrix OLED (AMOLED) can address these issues fairly well through inputting OLED current by switching transistors performing progressive scanning.

In design of the pixel circuit of the AMOLED, the issue that is mainly focused on is the nonuniformity of brightness of the OLED devices driven by the respective AMOLED pixel driving units.

First of all, AMOLED employs thin film transistors (TFTs) to construct the pixel driving unit so as to provide corresponding driving current for the light emitting devices. As known, the Low Temperature Poly-silicon (LTPS) TFTs or oxide TFTs are mostly used. As compared with a general A-Si TFTs, the LTPS TFTs and the oxide TFTs have characteristics of higher mobility and stability, and more suitable for the application of AMOLED display. However, due to limitation of crystallization process, LTPS TFTs fabricated on a glass substrate with large area often have a nonuniformity in terms of electrical parameters such as threshold voltage, mobility and the like, and this nonuniformity will be converted into difference in the driving current of the OLED devices and difference in brightness and can be perceived by human's eye, that is, a phenomenon of mura. Although the oxide TFTs is pretty good in terms of the uniformity of the process, similar to the A-Si TFTs, in case of being applied a voltage for a long time and high temperature, a drift will occur in the threshold voltage thereof, and since the display pictures are different, the drift amounts of the threshold values of the respective parts of the TFTs of the panel will be different, which will cause a difference in brightness display; since this difference is associated with a previous displayed images, it is generally presented as a phenomenon of image sticking.

Since the light emitting device of the OLED is a current driven device, in the pixel driving unit for driving the light emitting device to emit light, the characteristic of the threshold value of the driving transistor thereof has a great impact on the driving current and the final displayed brightness. Drift will occur in the threshold value of the driving transistor when the driving transistor is subjected to the voltage stress and illumination, and this drift in threshold value will be embodied as nonuniformity in brightness in terms of display effect.

In addition, in the pixel circuit of the known AMOLED, in order to eliminate the impact due to the threshold voltage of the driving transistor, the structure of the pixel circuit will be generally designed to be relatively complex, and this will directly lead to decrease in yield rate of pixel circuit of the AMOLED in the manufacture.

Therefore, in order to address the above issues, the present disclosure provides a pixel driving unit, a driving method thereof, as well as a pixel circuit.

SUMMARY

Embodiments of the present disclosure provide a pixel driving unit and a driving method thereof, as well as a pixel circuit capable of addressing the issue of the drift in the threshold value of the driving transistor in the known pixel driving unit.

The technical solutions of the present disclosure are realized as follows: a pixel driving unit comprising driving sub-circuits and a control sub-circuit, wherein the control sub-circuit is connected to a data line, and the driving sub-circuits are connected to the control sub-circuit.

Further, the control sub-circuit comprises a control transistor; the gate and the drain of the control transistor are connected together, and the source thereof is connected to the data line, and the drain of the control transistor is connected to the driving sub-circuits.

Further, at least three driving sub-circuits are included, wherein each of the driving sub-circuit includes a scanning signal line, a switching transistor, a storage capacitor, a driving transistor and a light emitting device; the gate of the switching transistor is connected to the scanning signal line, the source of the switching transistor is connected to the drain of the control transistor, and the drain of the switching transistor is connected to the gate of the driving transistor and a first terminal of the storage capacitor respectively; the source of the driving transistor is connected to a first voltage terminal and a second terminal of the storage capacitor respectively, and the drain the driving transistor is connected to the anode of the light emitting device; and the cathode of the light emitting device is connected to a second voltage terminal.

Further, the light emitting device is an organic light-emitting diode.

Further, each of the control transistor, the switching transistor and the driving transistor is a field effect transistor of P type.

A driving method for the pixel driving unit as described above comprises: applying, by the data line, a data voltage to the source of the control transistor, and providing the drain of the control transistor with the data voltage and the threshold voltage of the control transistor; and applying, by the drain of the control transistor, the data voltage to the driving sub-circuit together with the threshold voltage of the control transistor.

Further, the method further comprises the following steps of: turning on, in a storage period, the switching transistor by the scanning signal line; applying, by the drain of the control transistor, the data voltage together with the threshold voltage of the control transistor, to the gate of the driving transistor and the storage capacitor through the switching transistor; and turning off, in a driving period, the switching transistor by the scanning signal line; keeping the driving transistor to be turned on by the storage capacitor, so as to drive the light emitting device to emit light.

A pixel circuit comprises a plurality of the above data lines each connected a plurality of the above pixel driving unit.

A pixel circuit comprises a plurality of the above data lines each connected a plurality of the pixel driving unit as described above, and the above driving method is performed therein.

As compared with the known technique, the embodiments of the present disclosure have the following advantages.

Firstly, with a structure in which the gate and drain of the control transistor are connected with each other, the pixel driving unit of the present disclosure allows the drain of the control transistor to apply the data voltage to the driving sub-circuit together with the threshold voltage of the control transistor, so as to cancel the threshold voltage of the driving transistor in the driving sub-circuit; in the process of driving the light emitting device, it is possible to effectively eliminate the nonuniformity due to the threshold voltage of the driving transistor and a phenomenon of image sticking due to the threshold voltage drift, avoid a problem of nonuniform brightness of the active matrix OLED due to the difference of the threshold voltages of the driving transistors thereof between the light emitting devices of different pixel driving units of the active matrix OLED, and improve the driving effect of the pixel driving unit with respect to the light emitting device, and further improve the quality of the active matrix OLED.

Secondly, the driving sub-circuit of the present disclosure has a characteristic of simple structure, and can simplify the overall structure of the pixel driving unit and the pixel circuit and reduce the difficulty in manufacturing the pixel circuit; in the meanwhile, combining the driving sub-circuit of simple structure with the control transistor, it is possible to effectively reduce the difficulty in manufacturing the pixel driving unit and the pixel circuit and manufacture cost and improve the yield rate of the pixel circuit, while the driving effect for the pixel driving circuit is ensured.

BRIEF DESCRIPTION OF THE DRAWINGS

Hereinafter, the present disclosure will be further explained with reference to the appended drawings and the embodiments.

DETAILED DESCRIPTION

Hereinafter, the technical solutions of the embodiments of the present disclosure will be clearly and fully described in conjunction with the appended drawings of the embodiments of the present disclosure; obviously, the described embodiments are only a part of the embodiments of the present disclosure, rather than all of the embodiments. Based on the embodiments of the present disclosure, all the other embodiments acquired by those skilled in art without paying any inventive work are within the protection scope of the present invention.

Figure 1:
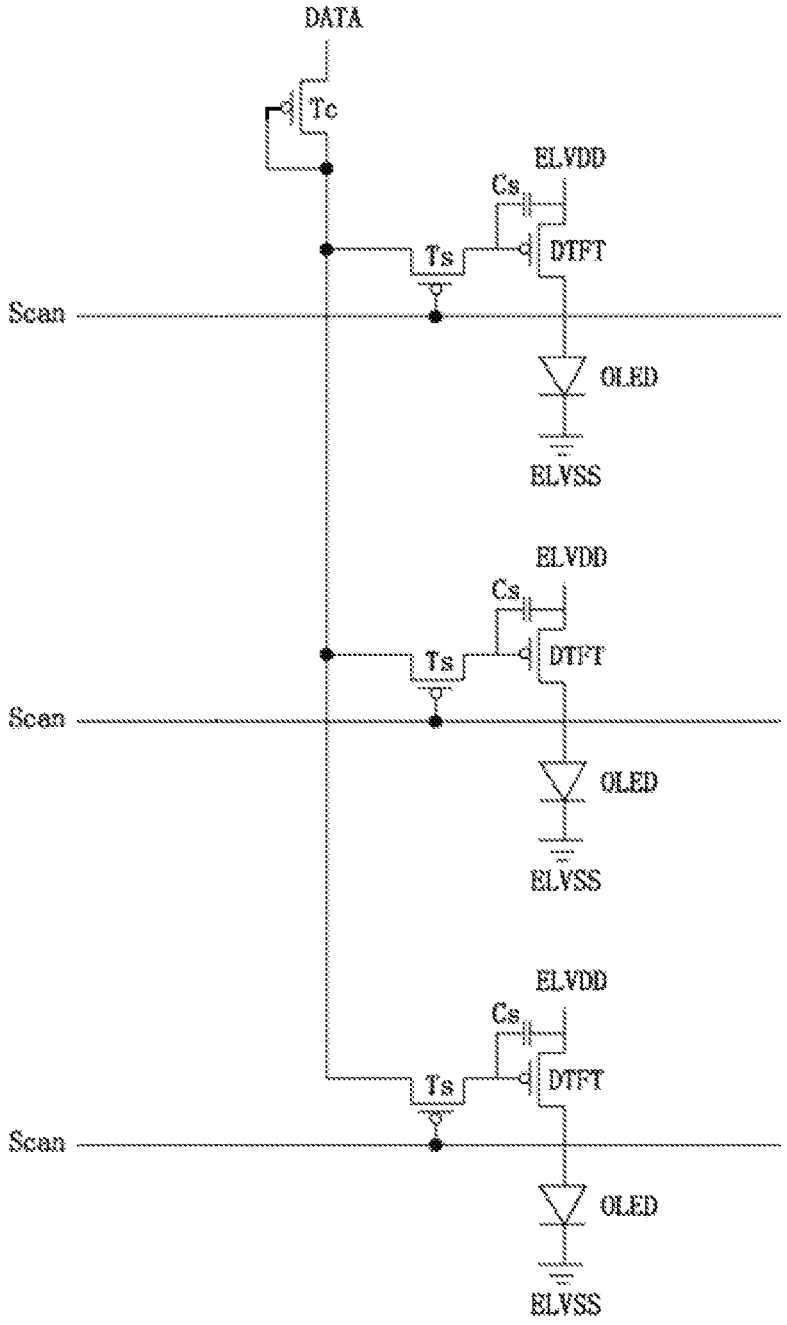
FIG. 1 is a schematic diagram of circuit connection of a pixel driving unit according to the present disclosure.

With reference to FIG. 1, the present embodiment provides a pixel driving unit comprising driving sub-circuits and a control sub-circuit, wherein an input terminal of the control sub-circuit is connected to a data line DATA, and an input terminal of the driving sub-circuit is connected to an output terminal of the control sub-circuit.

The control sub-circuit comprises a control transistor Tc; the gate of the control transistor Tc is connected the drain of the control transistor Tc, the source of the control transistor Tc is connected to the data line DATA, and the drain of the control transistor Tc is connected to respective driving sub-circuits.

The pixel driving unit of the present disclosure comprises at least three driving sub-circuits; in the following embodiments, a case in which there are three driving sub-circuits will be exemplified, and of course, it is also possible to choose more than three driving sub-circuits as necessary in practice; here, each of the driving sub-circuits comprises a scanning signal line Scan, a switching transistor Ts, a storage capacitor Cs, a driving transistor DTFT and a light emitting device OLED.

Herein, the gate of the switching transistor Ts is connected to the scanning signal line Scan, the source of the switching transistor Ts is connected to the drain of the control transistor Tc, and the drain of the switching transistor Ts is connected to the gate of the driving transistor DTFT and a first terminal of the storage capacitor Cs; the source of the driving transistor DTFT is connected to a first voltage terminal ELVDD and a second terminal of the storage capacitor Cs, and the drain of the driving transistor DTFT is connected to the anode of the light emitting device OLED; the cathode of the light emitting device OLED is connected to a second voltage terminal ELVSS.

The first voltage terminal ELVDD of the present disclosure is externally connected to an operational power supply, and serves to provide the operational power supply for the light emitting device OLED. The second voltage terminal ELVSS of the present disclosure is connected to the cathode of the light emitting device OLED; the second voltage terminal ELVSS serves to provide a reference voltage for the cathode of the light emitting device OLED. The second voltage terminal ELVSS of the present disclosure can be generally selected in a range of −5V to 0V, and can be obtained in accordance with practical adjustment to provide a reference potential for the above elements, such as zero line, ground line for providing a zero potential, negative voltage or the like. The light emitting device OLED of the present disclosure is an organic light-emitting diode (OLED device).

Each of the driving transistors DTFTs of the present disclosure is a field effect transistor of P type; the field effect transistor of P type is an enhanced type of field effect (the threshold voltage is positive) or depletion type (the threshold voltage is negative); each of the driving transistor DTFT, the switching transistor Ts and the control transistor Tc is the field effect transistor of P type.

With a structure in which the gate and drain of the control transistor Tc are connected with each other, the pixel driving unit of the embodiment of the present disclosure allows the drain of the control transistor Tc to apply the data voltage to the driving sub-circuit together with the threshold voltage of the control transistor Tc, so as to cancel the threshold voltage of the driving transistor DTFT in the driving sub-circuit; in the process of driving the light emitting device OLED, it is possible to effectively eliminate the nonuniformity due to the threshold voltage of the driving transistor DTFT and a phenomenon of image sticking due to the threshold voltage drift, avoid an issue of ununiform brightness of the active matrix OLED due to the difference of the threshold voltages of the driving transistors DTFTs therein between the light emitting devices OLEDs of different pixel driving units of the active matrix OLED, and improve the driving effect of the pixel driving unit with respect to the light emitting device OLED, and further improve the quality of the active matrix OLED.

The driving sub-circuit of this embodiment is a driving sub-circuit of 2T1C type, that is, one switching transistor Ts, one driving transistor DTFT and one storage capacitor Cs are included; it has a characteristic of simple structure, and can simplify the overall structure of the pixel driving unit and the pixel circuit and reduce the difficulty in manufacturing the pixel circuit; in the meanwhile, combining the driving sub-circuit of simple structure with the control transistor, it is possible to effectively reduce the difficulty in manufacturing the pixel driving unit and the pixel circuit and manufacture cost and improve the yield rate of the pixel circuit, while the driving effect for the pixel driving circuit is ensured.

Figure 2:
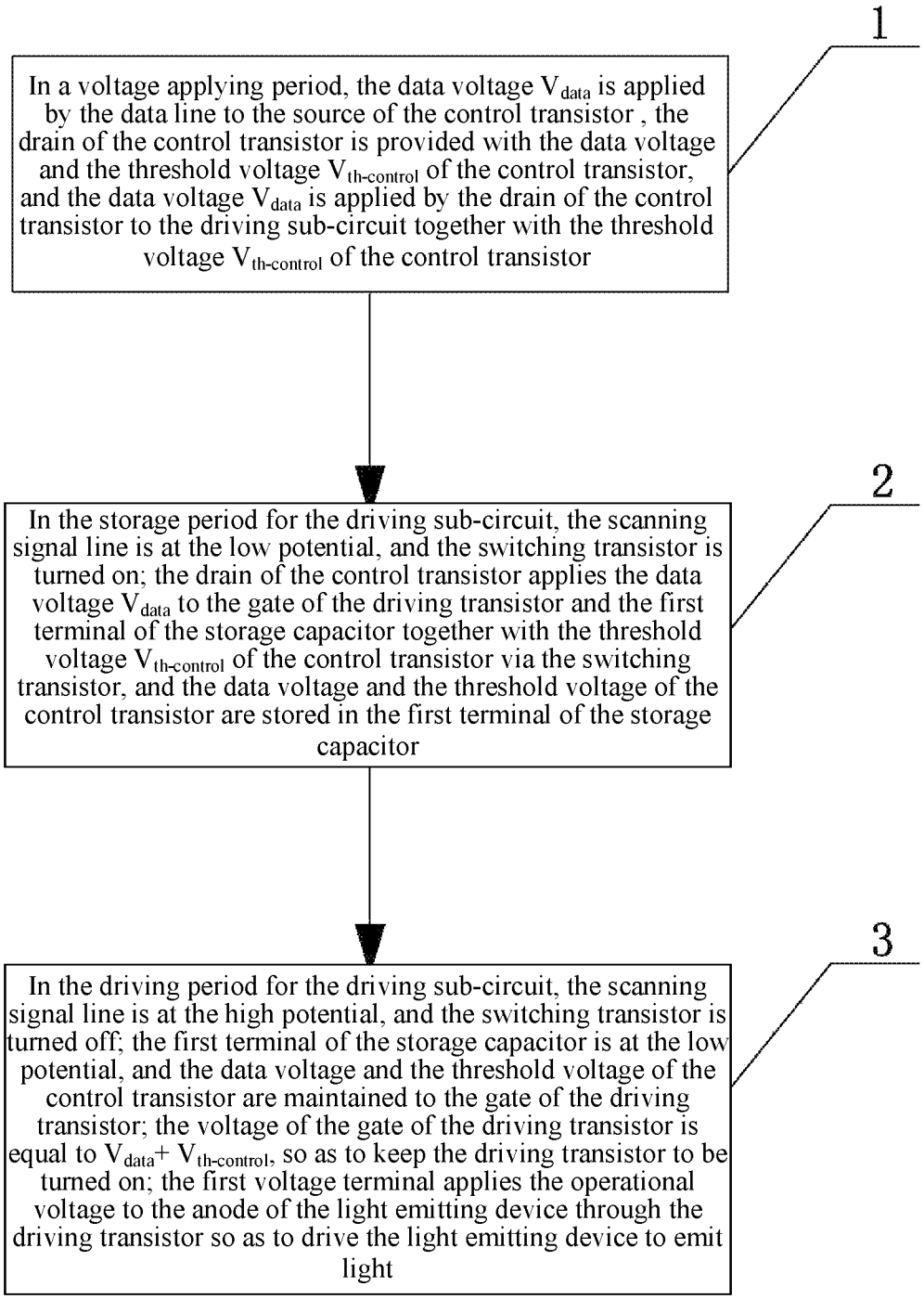
FIG. 2 is a block diagram of steps of a driving method according to the present disclosure.

With reference to FIG. 2, the present disclosure further provides a driving method of the pixel driving unit described above, which comprises a voltage applying period of applying, by the data line DATA, the data voltage $V_{data}$ to the source of the control transistor Tc, allowing the drain of the control transistor Tc to have the data voltage $V_{data}$ and the threshold voltage $V_{th\text{-}control}$ of the control transistor Tc, and applying, by the drain of the control transistor Tc, the data voltage $V_{data}$ to the driving sub-circuit together with the threshold voltage $V_{th\text{-}control}$ of the control transistor Tc.

The driving method further comprises a storage period for the driving sub-circuit, during which the scanning signal line Scan is at the low potential, and the switching transistor Ts is turned on; the drain of the control transistor Tc applies the data voltage $V_{data}$ to the gate of the driving transistor DTFT and the first terminal of the storage capacitor Cs together with the threshold voltage $V_{th\text{-}control}$ of the control transistor Tc via the switching transistor Ts, and the data voltage $V_{data}$ and the threshold voltage $V_{th\text{-}control}$ of the control transistor Tc are stored in the first terminal of the storage capacitor Cs.

The driving method further comprises a driving period for the driving sub-circuit, during which the scanning signal line Scan is at the high potential, and the switching transistor Ts is turned off; the first terminal of the storage capacitor Cs is at the low potential, and the data voltage $V_{data}$ and the threshold voltage $V_{th\text{-}control}$ of the control transistor Tc are maintained to the gate of the driving transistor DTFT; at this timing, the voltage of the gate of the driving transistor DTFT is equal to $V_{data}+V_{th\text{-}control}$, so as to keep the driving transistor DTFT to be turned on; the first voltage terminal ELVDD applies the operational voltage VDD to the anode of the light emitting device OLED through the driving transistor DTFT so as to drive the light emitting device OLED to emit light.

At this timing, the voltage of the gate of the driving transistor DTFT is maintained at $V_{data}+V_{th\text{-}control}$, and the voltage of the source of the driving transistor DTFT is an operational voltage of VDD; therefore, the driving voltage Vgs outputted from the drain of the driving transistor DTFT is calculated by a formula of $Vgs=V_{data}+V_{th\text{-}control}-VDD$; the driving current outputted to the light emitting device OLED via the driving transistor DTFT is calculated by a formula of $$I_{OLED}=\tfrac{1}{2}\cdot K\cdot[V_{gs}-V_{th\text{-}drive}]^2$$

where, K is a current constant related to the driving transistor OLED, and $V_{th\text{-}drive}$ is the threshold voltage of the driving transistor OLED; it can be known, from substituting the Vgs into the formula of the driving current $I_{OLED}$, that the driving current $I_{OLED}$ outputted to the light emitting device OLED via the driving transistor DTFT is expressed by a formula of $$I_{OLED}=\tfrac{1}{2}K\cdot[V_{data}+V_{th\text{-}control}-V_{DD}-V_{th\text{-}drive}]^2$$

Since an issue of short range uniformity between the threshold voltages of the control transistor Tc and the respective switching transistors Ts as well as the respective driving transistors DTFT is considered in the design of the pixel driving unit, in each of the pixel driving units, the threshold voltages of the control transistor Tc, switching transistor Ts and the driving transistor DTFT manufactured with the same design rule are approximately equal to each other; therefore, the threshold voltage of the control transistor Tc and the threshold voltage of the driving transistor DTFT described in the above formulas are cancelled with each other to obtain the following formula of $$I_{OLED}=\tfrac{1}{2}K\cdot[V_{data}-V_{DD}]^2$$

It can be known from the above calculations that the driving current $I_{OLED}$ flowing through the driving transistor DTFT is only related to the $V_{data}$ and the VDD, and is independent of the threshold voltage $V_{th\text{-}drive}$ of the driving transistor DTFT. Therefore, even if the $V_{th\text{-}drive}$ is lower than zero, it can be well compensated, and the impact of the nonuniformity and the drift of the threshold voltage of the driving transistor DTFT is basically eliminated. With the pixel circuit of the embodiments of the present disclosure, no matter with respect to the driving transistor of the enhanced type or depletion type, the impact of the nonuniformity of the threshold voltage can be eliminated, and thus the nonuniformity of brightness of the light emitting device can be greatly compensated and the application thereof is much wider.

Figure 3:
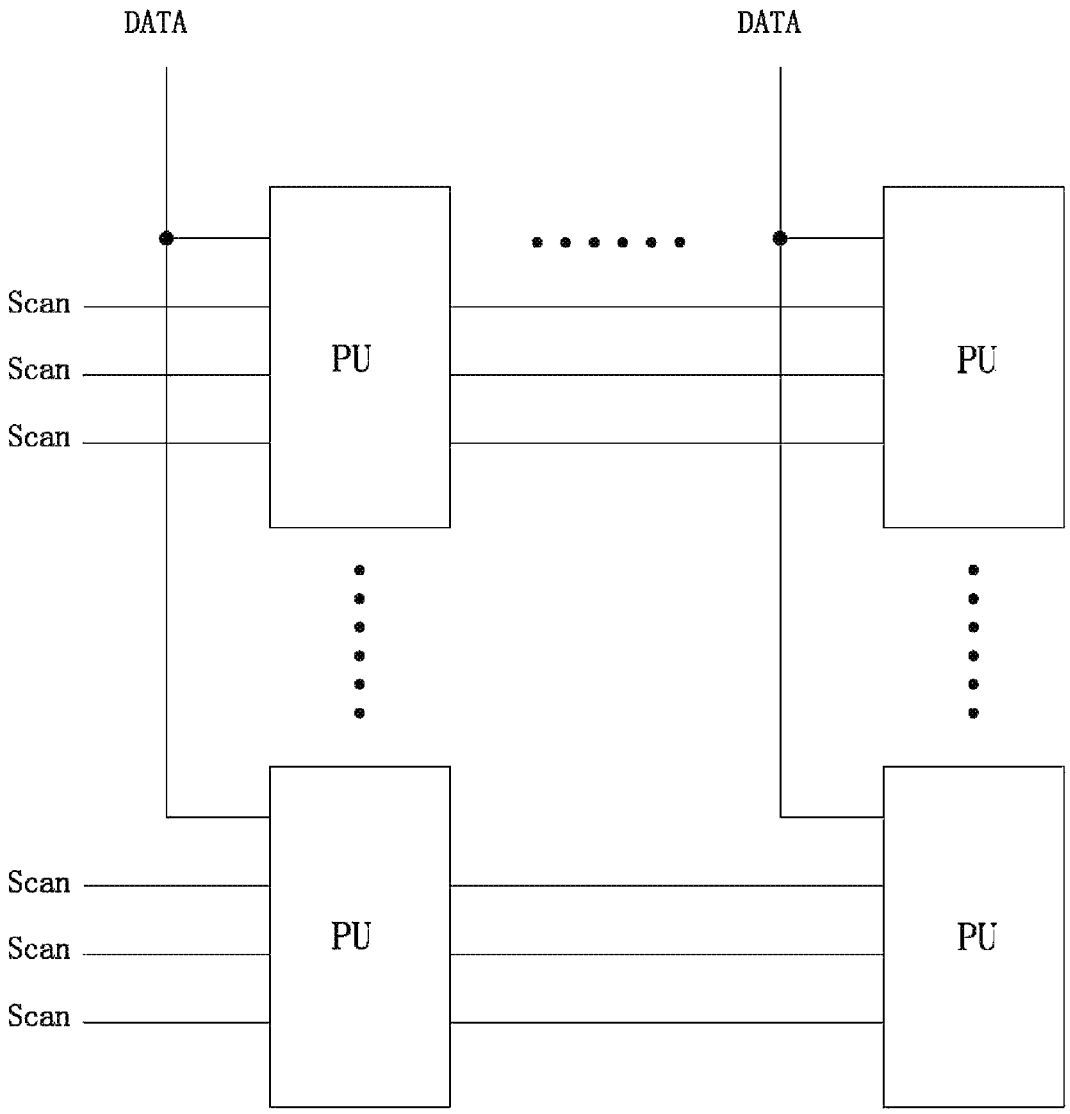
FIG. 3 is a schematic diagram of circuit connection of a pixel circuit according to the present disclosure.

With reference to FIG. 3, the present disclosure also provides a pixel circuit comprising a plurality of the above data lines DATAs, and each of the data lines is connected a plurality of the pixel driving units PUs as described above; Here, the source of the plurality of the control transistors Tc on the same column are connected to a same data line DATA, and the driving sub-circuits on the same row are connected to a same scanning signal line Scan.

It should be explained, the source and the drain of all transistors in the embodiments of the present disclosure are not distinguished from each other; for example, the source of the driving transistor can be also referred to as the drain of the driving transistor, and correspondingly, in this case, the drain of the driving transistor is referred to as the source of the driving transistor; that is to say, for the two terminals other than the gate, one is the source, and the other is the drain.

What is claimed is:

1. A pixel driving unit comprising a plurality of driving sub-circuits and a control sub-circuit, wherein the control sub-circuit is connected to a data line, and the plurality of driving sub-circuits are connected to the control sub-circuit;

wherein the control sub-circuit comprises a control transistor; a gate and a drain of the control transistor are connected together, a source thereof is connected to the data line, and a drain of the control transistor is connected to the plurality of driving sub-circuits;

wherein each of the plurality of driving sub-circuits includes a scanning signal line, a switching transistor, a storage capacitor and a driving transistor;

a gate of the switching transistor is connected to the scanning signal line, a source of the switching transistor is connected to the drain of the control transistor directly, and a drain of the switching transistor is directly connected to the gate of the driving transistor and a first terminal of the storage capacitor; and a source of the driving transistor is connected to a second terminal of the storage capacitor and a first voltage terminal, wherein the plurality of driving sub-circuits are connected to different scan signal lines respectively;

wherein a sum of a data voltage at the data line and a threshold voltage of the control transistor is applied to the gate of the driving transistor when the switching transistor is turned on so as to cancel an effect of a threshold voltage of the driving transistor;

wherein the pixel driving unit is configured to drive a single pixel comprising a plurality of sub-pixels, and the driving transistor included in each of the plurality of driving sub-circuits is configured to drive each of the plurality of sub-pixels;

the control transistor is shared by the plurality of driving sub-circuits and is configured to have a same threshold voltage as that of the driving transistor in each of the plurality of driving sub-circuits.

2. The pixel driving unit according to claim 1, wherein each of the plurality of driving sub-circuits further comprises a light emitting device; an anode of the light emitting device is connected to the drain of the driving transistor; and a cathode of the light emitting device is connected to a second voltage terminal.

3. The pixel driving unit according to claim 2, wherein the light emitting device is an organic light-emitting diode.

4. The pixel driving unit according to claim 3, wherein each of the control transistor, the switching transistor and the driving transistor is a field effect transistor of P type.

5. A driving method for a pixel driving unit comprising a plurality of driving sub-circuits and a control sub-circuit, wherein the control sub-circuit is connected to a data line, and the plurality of driving sub-circuits are connected to the control sub-circuit; wherein the control sub-circuit comprises a control transistor; a gate and a drain of the control transistor are connected together, a source thereof is connected to the data line, and a drain of the control transistor is connected to the plurality of driving sub-circuits;

wherein each of the plurality of driving sub-circuits includes a scanning signal line, a switching transistor, a storage capacitor and a driving transistor;

a gate of the switching transistor is connected to the scanning signal line, a source of the switching transistor is connected to the drain of the control transistor directly, and a drain of the switching transistor is directly connected to the gate of the driving transistor and a first terminal of the storage capacitor;

a source of the driving transistor is connected to a second terminal of the storage capacitor and a first voltage terminal;

wherein each of the plurality of driving sub-circuits further comprises a light emitting device; an anode of the light emitting device is connected to the drain of the driving transistor; and a cathode of the light emitting device is connected to a second voltage terminal; wherein the plurality of driving sub-circuits are connected to different scan signal lines respectively;

the method comprises:

applying, by the data line, a data voltage to the source of the control transistor, and providing the drain of the control transistor with the data voltage and a threshold voltage of the control transistor; and applying, by the drain of the control transistor, the data voltage together with the threshold voltage of the control transistor to the plurality of driving sub-circuit;

wherein a sum of a data voltage at the data line and a threshold voltage of the control transistor is applied to the gate of the driving transistor when the switching transistor is turned on so as to cancel an effect of a threshold voltage of the driving transistor;

wherein the pixel driving unit is configured to drive a single pixel comprising a plurality of sub-pixels, and the driving transistor included in each of the plurality of driving sub-circuits is configured to drive each of the plurality of sub-pixels;

the control transistor is shared by the plurality of driving sub-circuits and is configured to have a same threshold voltage as that of the driving transistor in each of the plurality of driving sub-circuits.

6. The driving method according to claim 5, further comprising:

turning on, in a storage period, the switching transistor by the scanning signal line; applying by the drain of the control transistor, together with the threshold voltage of the control transistor, the data voltage to the gate of the driving transistor and the storage capacitor via the switching transistor; and turning off, in a driving period, the switching transistor by the scanning signal line; keeping the driving transistor to be turned on by the storage capacitor, so as to drive the light emitting device to emit light.

7. A pixel circuit comprising a plurality of data lines, wherein each of the data lines is connected to a plurality of the pixel driving units each comprising a plurality of driving sub-circuits and a control sub-circuit, wherein the control sub-circuit is connected to a data line, and the plurality of driving sub-circuits are connected to the control sub-circuit;

wherein the control sub-circuit comprises a control transistor; a gate and a drain of the control transistor are connected together, a source thereof is connected to the data line, and a drain of the control transistor is connected to the plurality of driving sub-circuits;

wherein each of the plurality of driving sub-circuits includes a scanning signal line, a switching transistor, a storage capacitor and a driving transistor;

a gate of the switching transistor is connected to the scanning signal line, a source of the switching transistor is connected to the drain of the control transistor directly, and a drain of the switching transistor is directly connected to the gate of the driving transistor and a first terminal of the storage capacitor;

a source of the driving transistor is connected to a second terminal of the storage capacitor and a first voltage terminal;

wherein the plurality of driving sub-circuits are connected to different scan signal lines respectively;

wherein a sum of a data voltage at the data line and a threshold voltage of the control transistor is applied to the gate of the driving transistor when the switching transistor is turned on so as to cancel an effect of a threshold voltage of the driving transistor;

wherein each of the plurality of the pixel driving units is configured to drive a single pixel comprising a plurality of sub-pixels, and the driving transistor included in each of the plurality of driving sub-circuits is configured to drive each of the plurality of sub-pixels;

the control transistor is shared by the plurality of driving sub-circuits and is configured to have a same threshold voltage as that of the driving transistor in each of the plurality of driving sub-circuits.

8. The pixel circuit according to claim 7, wherein each of the plurality of driving sub-circuits further comprises a light emitting device; an anode of the light emitting device is connected to the drain of the driving transistor; and a cathode of the light emitting device is connected to a second voltage terminal.

9. The pixel circuit according to claim 8, wherein the light emitting device is an organic light-emitting diode.

10. The pixel circuit according to claim 9, wherein each of the control transistor, the switching transistor and the driving transistor is a field effect transistor of P type.

* * * * *